US006923352B2

(12) United States Patent
Oh

(10) Patent No.: US 6,923,352 B2
(45) Date of Patent: Aug. 2, 2005

(54) LUGGAGE CONTAINER WITH CONCEALED CARRYING MEANS

(75) Inventor: Scott Oh, Carson, CA (US)

(73) Assignee: Luggage America, Inc., Carson, CA (US)

( * ) Notice: Subject to any disclaimer, the term of this patent is extended or adjusted under 35 U.S.C. 154(b) by 159 days.

(21) Appl. No.: 10/310,434

(22) Filed: Dec. 4, 2002

(65) Prior Publication Data

US 2004/0108345 A1 Jun. 10, 2004

(51) Int. Cl.[7] ..... A45F 4/02

(52) U.S. Cl. ..... 224/153; 190/1; 190/18 A; 224/580

(58) Field of Search ..... 224/153, 580, 224/585, 627, 644; 190/1, 18, 18 A, 39, 115

(56) References Cited

U.S. PATENT DOCUMENTS 4,961,522 A * 10/1990 Weber ..... 224/153
5,524,920 A * 6/1996 Tsai ..... 190/18 A
5,749,503 A * 5/1998 Wulf et al. ..... 224/153
5,806,638 A * 9/1998 Mao ..... 190/115
5,865,281 A * 2/1999 Wang ..... 190/115
5,893,495 A * 4/1999 Godshaw et al. ..... 224/153
5,918,710 A * 7/1999 Sher ..... 190/18 A
5,984,154 A * 11/1999 Scicluna ..... 224/153
6,116,390 A * 9/2000 Cohen ..... 190/18 A
6,279,706 B1 * 8/2001 Mao ..... 190/115
6,530,507 B2 * 3/2003 Oh ..... 224/153
6,561,395 B2 * 5/2003 Lim et al. ..... 224/627
6,592,012 B2 * 7/2003 Godshaw et al. ..... 224/153

* cited by examiner

*Primary Examiner*—Gary E. Elkins
(74) *Attorney, Agent, or Firm*—Lee, Hong, Degerman, Kang & Schmadeka

(57) ABSTRACT

A container with a cover for concealing an extendable handle and shoulder straps attached to the container is provided. The container is configured to be wheeled on a set of wheels by way of the extendable handle in a first transport mode and carried on a person's back using the shoulder straps in a second transport mode. The container has a front compartment for storing items, and a rear compartment for housing the extendable handle and the shoulder straps that are attached to and used for carrying the container. The shoulder straps and the extendable handle are both deployable from a covered opening in the rear compartment proximate to the container's top. The container further comprises a cover for covering at least a portion of the set of wheels in a second transport mode.

27 Claims, 3 Drawing Sheets

LUGGAGE CONTAINER WITH CONCEALED CARRYING MEANS

BACKGROUND OF THE INVENTION

1. Field of the Invention

The present invention relates to generally to luggage containers. More specifically, this invention is directed to convertible luggage that can be used as a wheeled suitcase and backpack.

2. Discussion of the Related Art

A challenge to traveling has always been carrying one's belongings in the most efficient and easy manner. However, depending on the circumstances, one bag is often not the best for all situations. Depending on pavement conditions, the number of stairs, etc., a backpack can be best fitted for situations where the bag must be carried. At other times, a wheeled suitcase is best to transport heavier baggage through airports and roads. A problem arises when a traveler is confronted with more than one type of terrain during a single trip or the traveler is preparing to travel to an unknown destination. To meet this challenge, convertible luggage designs have appeared in the prior art to convert from a wheeled suitcase to a backpack, and vice versa. Such designs, however, have straps that interfere with the wheeled suitcase, and at the same time the wheels interfere with the user while wearing the suitcase as a backpack. That is, the wheels rub against the back of the wearer of the backpack. In addition, some prior art designs have an extendable handle that cannot be hidden from view, further affecting the aesthetics and comfort of the backpack.

Although various attempts have been made to solve the above problems, an improved design is needed as convertible suitcases become increasingly popular.

SUMMARY OF THE INVENTION

The present invention is directed to an improved container with a cover for concealing the carrying means attached to the container.

To achieve these and other advantages and in accordance with the purpose of the present invention, as embodied and broadly described, a container for carrying one more items comprises a front compartment for storing one or more items and a rear compartment for housing carrying means used to carry the container and attached to the container. The carrying means can be at least partially concealed from view in a first or second transport mode. The front and the rear compartments may also share a common wall.

According to one aspect of an embodiment of the present invention, the container may further comprise a set of wheels attached approximately to a lower portion of the container, so that the container can be wheeled in the first transport mode. According to another aspect, the carrying means may comprise one or more handles attached approximately to an upper portion of the container that can be deployed from the rear compartment so that the container can be wheeled in the first and carried in the second transport mode. Further, one of the one or more handles may be an extendable handle that can be deployed to facilitate wheeling the container in the first transport mode.

According to another aspect of an embodiment of the present invention, the carrying means may comprise one or more handles attached approximately to an upper portion of the container, wherein the one or more handles can be deployed from the rear compartment so that the container can be carried in the first or the second transport mode. Also, one of the one or more handles may be a strap that can be deployed from the rear compartment to facilitate carrying the container on a person's back in the second transport mode.

According to another aspect of an embodiment of the present invention, the container may include a frame structure comprising a base having an upper and lower portions, (wherein the upper portion is attached to a lower portion of the container), a set of wheels attached to the bottom portion of the base, and an elongated telescopic handle approximately perpendicularly attached to the base. The elongated telescopic handle is in operational relationship with the second compartment to support the container to stand in an upright position, such that in the first transport mode a person can use the telescopic handle to wheel the container, and in the second transport mode the elongated telescopic handle provides a support structure for a person to carry the container on his back using a set of shoulder straps secured to the container.

According to another aspect of an embodiment of the present invention, the carrying means of the container may comprise a set of wheels attached approximately to a lower portion of the container, a set of shoulder straps and at least one extendable handle deployable from the rear compartment. The container may further comprise a cover for covering at least a portion of the set of wheels in a second transport mode. The container is configured to be wheeled on the set of wheels by way of the extendable handle and first and carried on a person's back using said set of shoulder straps in the first and second transport modes, respectively. The rear compartment may comprise an opening proximate to the container's top from which the set of shoulder straps may be deployed, and a cover for covering said opening for fully concealing the carrying means from view in a closed position. The cover may be fastened by way of a fastener, such as a zipper, to the outer surface of the second compartment to cover the opening.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
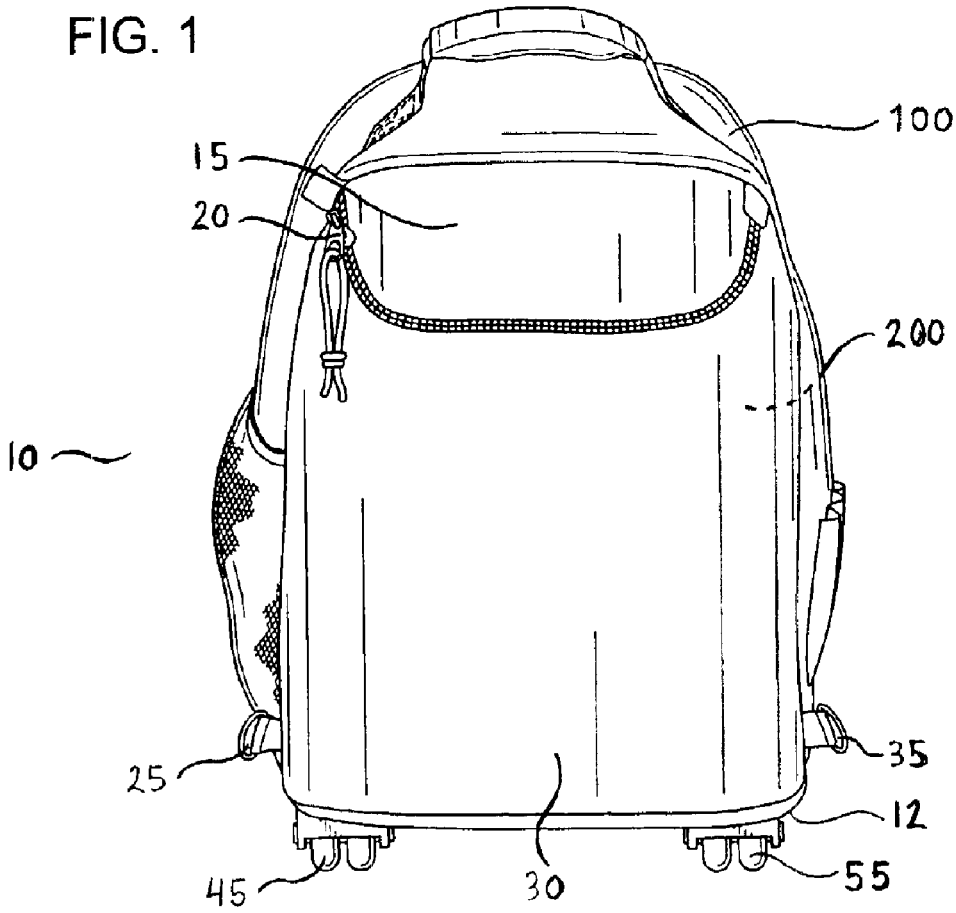
FIG. 1 is a rear view of the convertible backpack in stowage configuration in accordance with the one of the embodiments of the present invention.

Hereinafter, the present invention will be described with respect to the preferred embodiment illustrated in the annexed drawings.

Referring to FIGS. 1–5, in accordance with one embodiment, a convertible backpack 10 has at least a front compartment 100, to store a user's belongings, and a rear compartment 200 sharing a common wall with the first compartment 100 for housing the backpack's carrying means, such as shoulder straps 65 and 75, and handle 60.

In one embodiment, a cover 30 defines the outer surface of the rear compartment 200. The cover 30 is preferably padded for user comfort since the cover 30 is the portion of the backpack 10 that will be in contact with the user's back when the backpack 10 is being carried. The bottom edge of the cover 30 is not attached to the backside of the rear compartment 200 in some embodiments to allow for installation of a carrying cart with a set of wheels and an extendable handle, for example.

Figure 2:
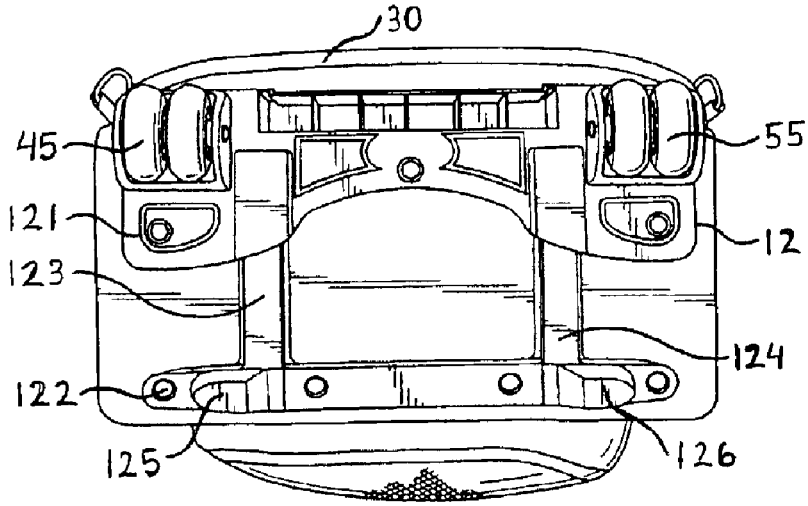
FIG. 2 is a bottom view of the convertible backpack in stowage configuration in accordance with one of the embodiments of the present invention.

Referring to FIGS. 1 and 2, the carrying means of the backpack 10 are configured for stowage within the second compartment 200. As shown, the extendable handle 60 and shoulder straps 65 and 75 are accessible preferably via a zipper 20 attached to a flap 15, which encloses the top portion of the second compartment 200 by fastening to the cover 30. Alternatively, any suitable fastener known to one of ordinary skill in the art, such as snaps, hook and loop fasteners or the like, can be used to fasten the flap 15 to cover 30.

Referring to FIG. 2, the base 12 preferably is made of plastic, polyvinyl chloride (PVC), metal, or other suitable material known to one of ordinary skill in the art. The base 12 is preferably attached permanently to the backpack 10 by rivets although other suitable means of attachment known to one of ordinary skill in the art, such as stitching or adhesives, can be used. In this embodiment, the base 12 comprises front and rear elongated members 121 and 122, respectively, which span substantially the bottom width of the backpack 10 and are connected by two cross-bars 123 and 124. Wheels 45 and 55 are preferably attached to the rear elongated member 121 at laterally opposite ends to provide maximum lateral stability when the backpack 10 is transported in wheeled suitcase mode. The front elongated member preferably comprises two legs, 125 and 126, situated at laterally opposite ends. The legs 125 and 126 are substantially the same length as the sum of the diameter of the wheels 45 and 55 and the clearance width between the wheels 45 and 55 and the base 12. Consequently, the backpack 10 is level and vertically stable with respect to a flat surface when it is not being transported and is resting upright.

Figure 3:
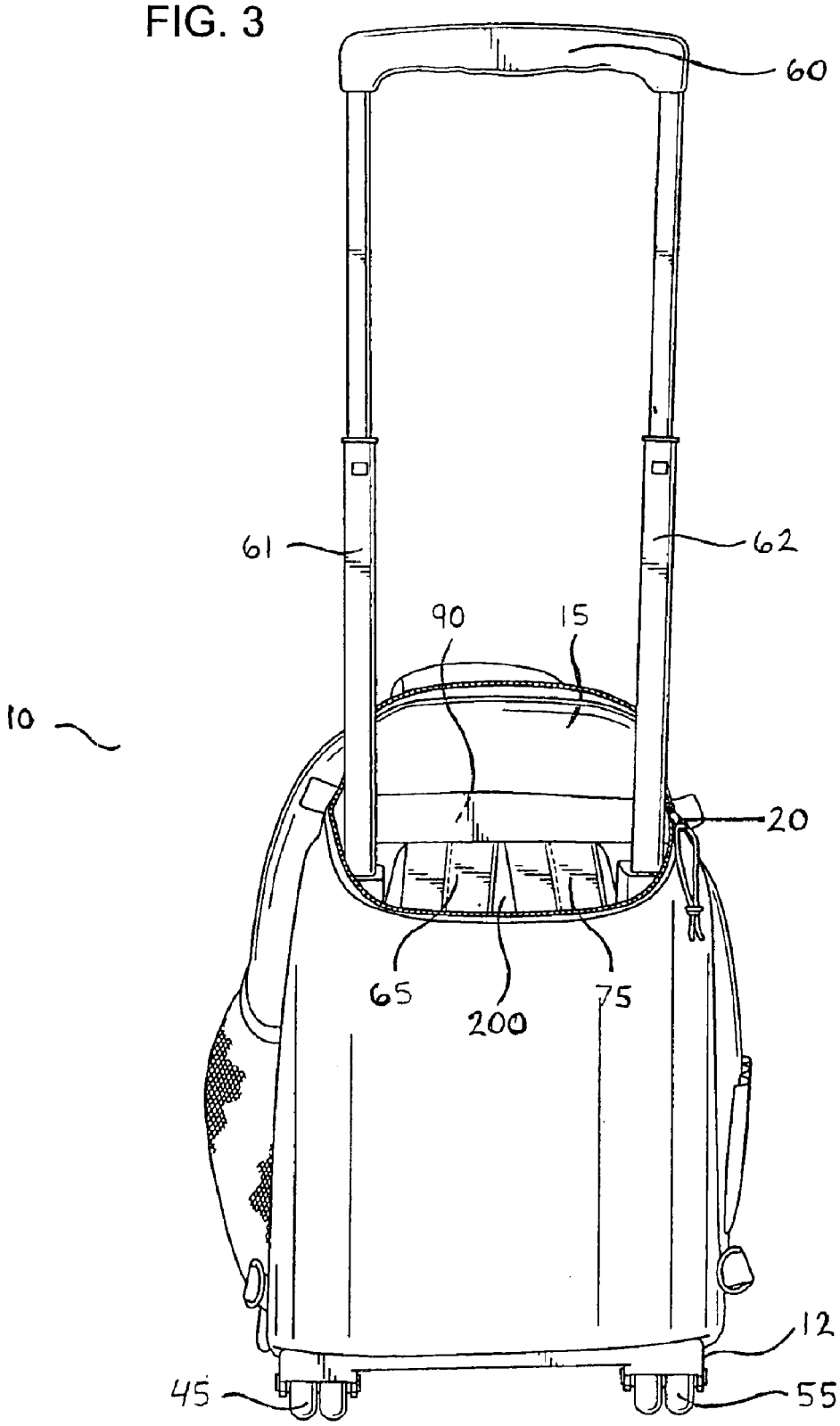
FIG. 3 is a rear view of the convertible backpack in wheeled suitcase configuration in accordance with one of the embodiments of the present invention.

The backpack 10 can be formed of any durable material, such as canvas, fabric, nylon, leather, plastic (e.g. vinyl), etc. The backpack 10 has an external rigid base 12 to which wheels 45 and 55 are preferably attached. According to one embodiment of the present invention, the wheels 45 and 55 are dual wheels (two wheels on each side) to provide stability and easy transport. Referring to FIG. 3, the extendable handle 60 can extend upwardly from the open end of the rear compartment 200 via two telescoping members 61 and 62. The base of the shafts that contain the two telescoping members 61 and 62 are also preferably attached to the rigid base 12 for additional stability. Preferably, the base of the shafts that contain the two telescoping members 61 and 62 are connected to the rear elongated member 121 for comfort and stability when wheeling the backpack 10. The members 61 and 62 are further attached to each other near the upper edge of the second compartment 200, in one embodiment, via a cross bar 90 for further stability. The cross bar 90 is preferably flat and enclosed within a pocket or covering affixed to the backpack 10 for additional stability and aesthetics.

Figure 4:
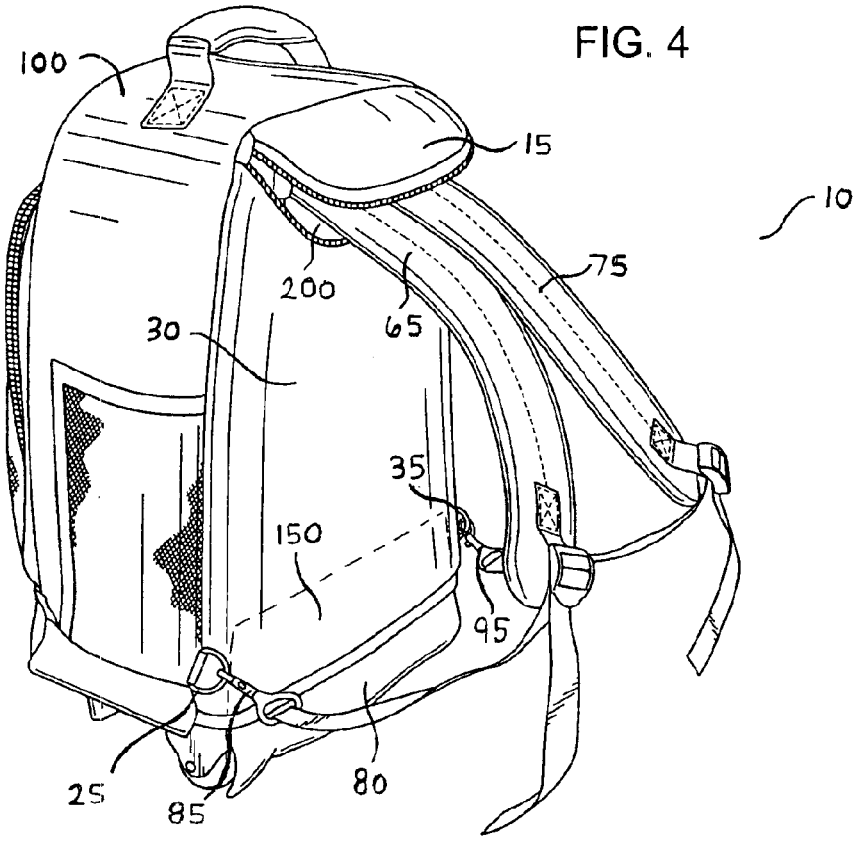
FIG. 4 is a rear perspective view of the convertible backpack in backpack configuration in accordance with one of the embodiments of the present invention.
Figure 5:
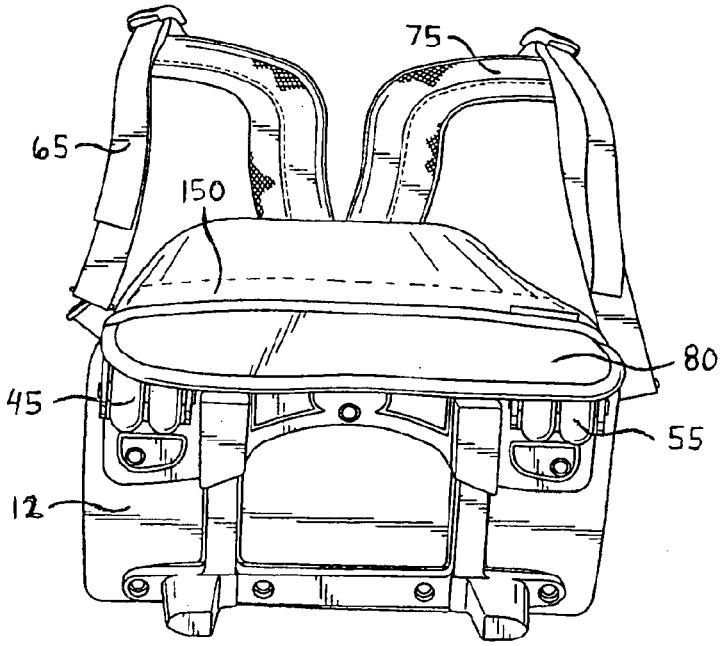
FIG. 5 is bottom perspective view of the convertible backpack in backpack configuration in accordance with one of the embodiments of the present invention.

Referring to FIGS. 4 and 5, the backpack 10 may comprise a flap 80 that can be unfolded or extracted to cover the wheels 45 and 55 when a user is carrying the backpack 10 on his back to provide added cushioning and comfort. Flap 80 is attached to the lower end of the rear backpack 10, in proximity of wheels 45 and 55 so that, in an unfolded or extracted position, the flap 80 can fully or at least partially cover the wheels 45 and 55. In certain embodiments, a fastening means, such as snaps, hook and loop fasteners, or the like may be used to detachably fasten the distal end of the flap 80 to the bottom portion of the backpack 10 so that the flap 80 can wrap around the wheels 45 and 55 to protect the user's back from discomfort that may result from pressure from the wheels 45 and 55 placed on his back. The flap 80 of certain length is extracted from the bottom edge of the backpack 10 to provide a barrier between the wheels 45 and 55 and the user's back in order to also protect it from debris accumulated on the wheels 45 and 55 when rolled along an unclean surface. The flap 80 may be affixed to the cover 30 by stitching or other suitable means known to one of ordinary skill in the art. Alternatively, the flap can be affixed to the backside of the front compartment 100 or the backside rear compartment 200.

When the backpack 10 is in wheeled suitcase configuration, as shown in FIG. 3, the flap 80 is folded up between the backside of the front compartment 100 and the cover 30. This prevents the wheels 45 and 55 from marring the flap 80 while the backpack 10 is being rolled. In other embodiments as shown in FIGS. 4 and 5, the flap 80 can be extracted from a pocket 150 located on the lower, rear side of the backpack 10. The pocket 150 may be created by attaching the cover 30, by stitching or other means well known in the art, to the rear side of the first compartment 100 a certain distance from the bottom edge of the backpack 10 so as to accommodate the flap 80 when it is inserted into the pocket 150. Additionally, the pocket 150 prevents the second ends of the shoulder straps 65 and 75, as described below, from exposure at the bottom edge of the backpack 10.

The shoulder straps 65 and 75 are comprised of standard extendable, cushioned shoulder pads used with existing backpacks and well known in the art. The first ends of the shoulder straps 65 and 75 are permanently affixed to the backpack 10 by stitching or other suitable fasteners known to one of ordinary skill in the art. Preferably, the first ends of the shoulder straps 65 and 75 are affixed within and at the upper edge of the rear compartment 200. The second ends of the shoulder straps 65 and 75 are provided with latches 85 and 95, respectively. The latches 85 and 95 are extracted from within the rear compartment 200 to fasten the shoulder straps 65 and 75 to corresponding attaching means on the outer surface of the backpack 10, such as rings 25 and 35, respectively. The rings 25 and 35 are preferably located on the lower, rear side edges of the backpack 10. Alternatively, any suitable fastening means known to one of ordinary skill in the art, such as male-female fasteners, pressure-release fasteners, clasps or the like, can be used to fasten the shoulder straps 65 and 75 to the lower, rear side edges of the backpack 10. Attaching the second ends of the shoulder straps 65 and 75 allows them to be worn over the user's shoulders such that the backpack 10 is carried snug across the user's back.

Those skilled in the art will appreciate that alternative embodiments exists from the description of the preferred embodiments without departing from the spirit and scope of the invention. Preferred embodiments were shown in the context of a standard backpack. However, in alternative embodiments, a backpack with additional compartments can be substituted for the preferred backpack. For example, a third compartment can be affixed to the front side of the first compartment, where the third compartment is optionally removable as a day pack. Further, the features disclosed here may have application for use with any type of luggage or carrying container.

In the described embodiments, the shoulder straps were described as standard extendable cushioned shoulder straps. In alternative embodiments, the shoulder straps can take any known mechanism allowing the user to hold the luggage on the user's back. For example, the shoulder straps can comprise a single strap to place over one shoulder and body of the user while the user wears the luggage in the backpack mode.

Therefore, the foregoing description of the preferred embodiments of the invention has been presented for the purposes of illustration and is not intended to be exhaustive or limiting the invention to the precise form disclosed. Many modifications and variations are possible in light of the above teaching. Other embodiments of the invention may be made without departing from the spirit and scope of the invention.

What is claimed is:

1. A container for carrying one or more items, the container comprising:

a front compartment for storing one or more items; and a rear compartment for housing carrying means used for carrying the container, said carrying means being attached to the container;

wherein the rear compartment houses the carrying means as attached to the container, such that said carrying means can be at least partially concealed from view in a first or a second transport mode;

wherein the rear compartment comprises an opening proximate to the container's top from which the carrying means may be deployed and a cover for covering the opening for fully concealing the carrying means from view in a closed position.

2. The container of claim 1, further comprising a set of wheels attached approximately to a lower portion of the container, so that the container can be wheeled in the first transport mode.

3. The container of claim 2, wherein the carrying means comprise one or more handles attached approximately to an upper portion of the container that can be deployed from the rear compartment so that the container can be wheeled in the first transport mode and carried in the second transport mode.

4. The container of claim 3, wherein one of the one or more handles is an extendable handle that can be deployed to facilitate wheeling the container in the first transport mode.

5. The container of claim 3, wherein one of the one or more handles includes a set of shoulder straps deployable from the rear compartment to facilitate carrying the container in the second transport mode.

6. The container of claim 1, further comprising a frame structure comprising:

a base having upper and lower portions, wherein the upper portion is attached to a lower portion of the container;

a set of wheels attached to the lower portion of the base; and the carrying means comprising an elongated telescopic handle and a set of shoulder straps, wherein the elongated telescopic handle is approximately perpendicularly attached to the base and in operational relationship with the rear compartment to support the container to stand in an upright position, such that in the first transport mode a person can use the telescopic handle to wheel the container, and in the second transport mode the elongated telescopic handle provides a support structure for a person to carry the container on his back using the set of shoulder straps secured to the container.

7. The container of claim 6, wherein the frame structure further comprises a flat cross bar affixed to the elongated telescopic handle to enhance stability in the first and second transport modes.

8. The container of claim 6, wherein the front and the rear compartments share a common wall.

9. The container of claim 1, wherein the carrying means comprises a set of shoulder straps and at least one extendable handle deployable from the rear compartment, the container further comprising a set of wheels attached approximately to a lower portion of the container and a cover for covering at least a portion of the set of wheels in the second transport mode.

10. The container of claim 9, wherein in the second mode the container is configured to be carried on a person's back using said set of shoulder straps.

11. The container of claim 9, wherein in the first transport mode the container is configured to be wheeled on the set of wheels by way of the extendable handle.

12. The container of claim 9, wherein the set of shoulder straps may be deployed from the opening proximate to the container's top.

13. The container of claim 1, wherein the cover can be fastened by way of a fastener to the outer surface of the rear compartment to cover the opening.

14. The container of claim 13, wherein the fastener is in form of a zipper.

15. The container of claim 6, wherein the lower portion of the base comprises:

a rear elongated member having substantially the same width as the bottom side of the front compartment, wherein the set of wheels are attached to the rear elongated member at laterally opposite ends;

a front elongated member connected to the rear elongated member by one or more cross-bars; and one or more legs attached to the front elongated member having a length such that the container is substantially level with respect to a horizontal plane.

16. The container of claim 15, wherein the base is affixed to the bottom of the first compartment using rivets.

17. The container of claim 15, wherein the telescopic handle is connected to the rear elongated member of the base.

18. A backpack, comprising:

a front compartment;

a rear compartment for housing carrying means used for carrying the backpack, the carrying means being attached to the backpack; and a set of wheels attached approximately to a lower portion of the backpack;

wherein the rear compartment houses the carrying means as attached to the backpack such that the carrying means can be at least partially concealed from view in a first or a second transport mode;

wherein the rear compartment comprises an opening proximate to the backpack's top from which the carrying means may be deployed and a cover for covering the opening for fully concealing the carrying means from view in a closed position.

19. The backpack of claim 18, wherein the carrying means comprise one or more handles attached to the backpack that can be deployed from the rear compartment so that the backpack can be wheeled in the first transport mode and carried in the second transport mode.

20. The backpack of claim 19, wherein one of the one or more handles comprises an extendable handle that can be deployed to facilitate wheeling the backpack in the first transport mode.

21. The backpack of claim 19, wherein one of the one or more handles comprises a set of shoulder straps that can be deployed to facilitate carrying the backpack in the second transport mode.

22. The backpack of claim 18, further comprising a frame structure comprising:

a base having upper and lower portions, wherein the upper portion of the base is attached to a lower portion of the backpack;

the set of wheels being attached to the lower portion of the base; and the carrying means comprising an elongated telescopic handle and a set of shoulder straps, wherein the elongated telescopic handle is attached to the base and in operational relationship with the rear compartment to support the backpack to stand in an upright position such that in the first transport mode a person can use the telescopic handle to wheel the backpack, and in the second transport mode the elongated telescopic handle provides a support structure for a person to carry the backpack on his back using the set of shoulder straps secured to the backpack.

23. The backpack of claim 18, wherein the carrying means comprises a set of shoulder straps and at least one extendable handle deployable from the rear compartment, the backpack further comprising a cover for covering at least a portion of the set of wheels in the second transport mode.

24. The backpack of claim 18, wherein the cover can be fastened by way of a fastener to the outer surface of the rear compartment to cover the opening.

25. The backpack of claim 22, wherein the lower portion of the base comprises:

a rear elongated member having substantially the same width as the bottom side of the front compartment, wherein the set of wheels are attached to the rear elongated member at laterally opposite ends;

a front elongated member connected to the rear elongated member by one or more cross-bars; and one or more legs attached to the front elongated member having a length such that the backpack is substantially level with respect to a horizontal plane.

26. The backpack of claim 25, wherein the telescopic handle is connected to the rear elongated member of the base.

27. A backpack, comprising:

a set of wheels attached approximately to a lower portion of the backpack;

a front compartment; and a rear compartment for housing an extendable handle and a set of shoulder straps, the extendable handle deployable from the rear compartment to facilitate wheeling the backpack in a first transport mode, the set of shoulder straps deployable from the rear compartment to facilitate carrying the backpack in a second transport mode;

wherein the rear compartment houses the extendable handle and the set of shoulder straps such that the extendable handle or the set of shoulder straps can be at least partially concealed from view in the first or the second transport mode;

wherein the rear compartment comprises an opening proximate to the backpack's top from which the extendable handle and the set of shoulder straps may be deployed, the rear compartment further comprising a cover for covering the opening and fully concealing the extendable handle and the set of shoulder straps from view in a closed position.

* * * * *